United States Patent [19]

Frank

[11] 4,177,879

[45] Dec. 11, 1979

[54] LADDER AND METHOD OF CONSTRUCTION THEREFOR

[75] Inventor: William H. Frank, Louisville, Ky.

[73] Assignee: Emerson Electric Co., St. Louis, Mo.

[21] Appl. No.: 818,590

[22] Filed: Jul. 25, 1977

[51] Int. Cl.[2] ..... E06C 7/08; E06C 7/50

[52] U.S. Cl. ..... 182/220; 182/228; 182/46

[58] Field of Search ..... 182/46, 228, 194, 220, 182/219; 264/273, 274

[56] References Cited

U.S. PATENT DOCUMENTS

| | | | |
|---|---|---|---|
| 817,174 | 4/1906 | Jones | 182/220 |
| 2,821,764 | 2/1958 | Leahy | 264/273 |
| 3,225,862 | 12/1965 | Fink | 182/228 |
| 3,354,987 | 11/1967 | Werner | 182/228 |
| 3,481,428 | 12/1969 | Merritt | 182/228 |
| 3,502,173 | 3/1970 | Arnold | 182/228 |

FOREIGN PATENT DOCUMENTS

| | | | |
|---|---|---|---|
| 264096 | 6/1964 | Netherlands | 182/228 |

*Primary Examiner*—Reinaldo P. Machado
*Attorney, Agent, or Firm*—Polster, Polster and Lucchesi

[57] ABSTRACT

A ladder with elongated side rails each with a web with two broad surfaces, and rungs supported by and extending between the webs of the side rails at spaced locations, has rung brackets molded into and embracing the webs, each of the rung brackets having a rung receiving boss and a base part on one broad surface of the web and a pad part on the other broad surface, and tying members, integral with the base and pad parts, connecting the parts and extending into the web. In making the ladder, holes are formed in the webs at the rung locations and the rung brackets are molded in place in and through those holes.

5 Claims, 14 Drawing Figures

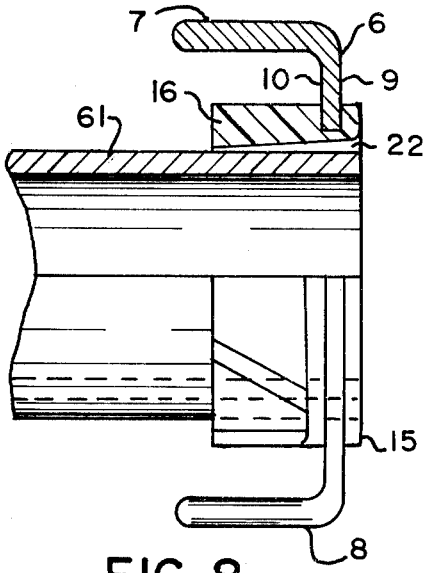
FIG. 8.
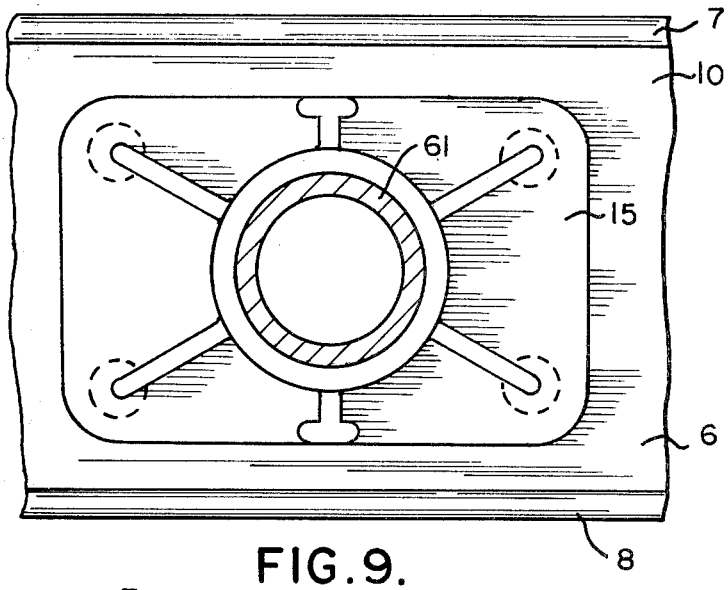
FIG. 9.
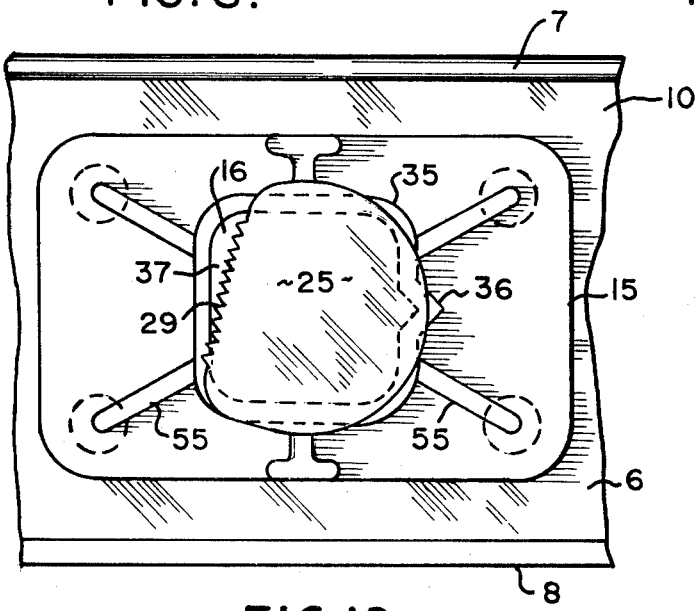
FIG. 10.
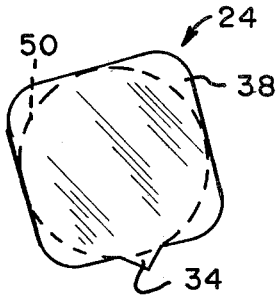
FIG. 11.
FIG. 12.
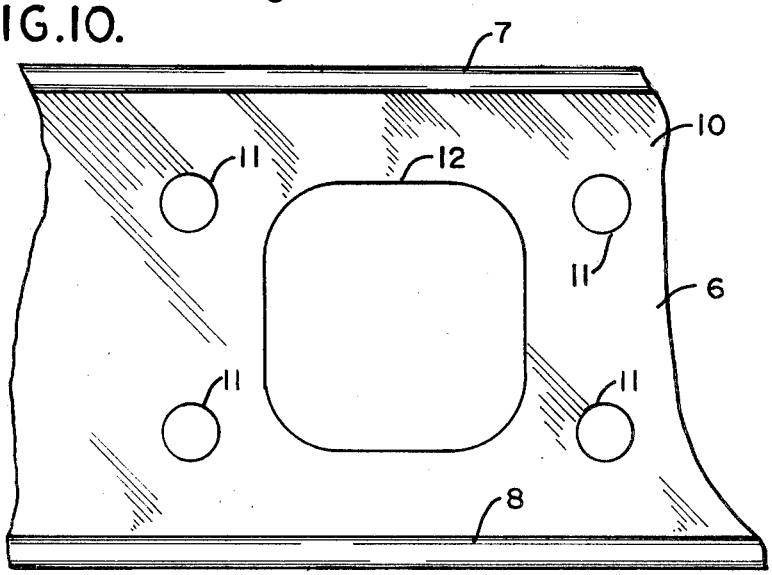

LADDER AND METHOD OF CONSTRUCTION THEREFOR

BACKGROUND OF THE INVENTION

This invention relates to ladder construction, and in particular, to a ladder having an integrally molded rung flange mounted along the web of the ladder side rails.

In ladders, particularly all plastic extension ladders with rungs and side rails made by the pultrusion process, the rungs have been mounted in the ladder webs by assemblies of individual plastic parts. An illustrative example of such assemblies and ladder construction method is shown and described in the U.S. Pat. No. 3,426,867 to Berger. While this has produced a satisfactory ladder, the assembly of the various parts is a relatively time consuming and expensive procedure.

It has been suggested to mold rung receiving bosses integral with the web or side piece of the spaced side rails, as disclosed in Merritt et al, U.S. Pat. No. 3,481,428. Such a construction is difficult to accomplish and precludes the use of a different material for the rung brackets from the material of which the rails are made. In addition, ladders constructed in accordance with Merritt have a web that is reinforced only on one broad side.

The invention disclosed hereinafter overcomes the deficiencies of the prior art by providing a structure and method of manufacturing a rung flange so that the flange becomes an integral part of the side rails. Ladder construction is simplified and rung insertion and attachment is easily accomplished.

One of the objects of this invention is to provide a ladder and method of making it which is more economical and at the same time produces a stronger construction than that of ladders of the same general type known heretofore.

Another object of this invention is to provide a rung flange which may be molded and integrally attached to the side rail of a ladder.

Other objects will become apparent to those skilled in the art in light of the following description and accompanying drawings.

SUMMARY OF THE INVENTION

In accordance with this invention, generally stated, a ladder having two elongated side rails each with a web having a broad surface is provided with a rung flange or bracket integrally connected to the existing web. The rung brackets are molded in place on the existing web so that each bracket has on one broad side of the web a rung receiving boss and a base part integral with the boss, and, on the opposite broad side of the web, a pad part, and a tying member, integral with the base and pad parts, connecting the parts and extending through the web. In the preferred embodiment, a large rung hole is provided in the web at each of the rung locations. A plurality of smaller, satellite holes are spaced from the large holes and specifically placed in relation thereto. The pad and base parts cover all of the small holes and tying members extend through the rung hole and all of the smaller holes.

The ladder is made by forming holes in the webs at the desired locations and molding in place in and through the holes a rung bracket having a rung receiving boss, a base part on the side of the web with the boss, a pad part on the other side of the web and at least one tying member integral with the base and pad parts, connecting the parts and extending through the web. The rung bosses preferably are hollow and the rungs project into them, and are cemented into place. In the preferred embodiment of method, the web is clamped between two mold parts of an injection molding machine and plastic is injected into the mold parts under high pressure from one side of the web.

BRIEF DESCRIPTION OF THE DRAWINGS

In the drawings.

FIG. 8 is a view partly in section longitudinally of a rung and transversely of a side rail of another embodiment of ladder of this invention;

FIG. 9 is a view in traverse cross section of a rung and front elevation of a rung boss and side rail of the embodiment of ladder shown in FIG. 8;

FIG. 10 is a fragmentary view in front elevation of a side rail of a ladder incorporating rungs shown in FIGS. 4 and 5;

FIG. 11 is a view in end elevation of another embodiment of rung;

FIG. 12 is a fragmentary view in front elevation of a side rail showing the web prior to its having a rung bracket molded onto it;

DESCRIPTION OF THE PREFERRED EMBODIMENT

Figure 1:
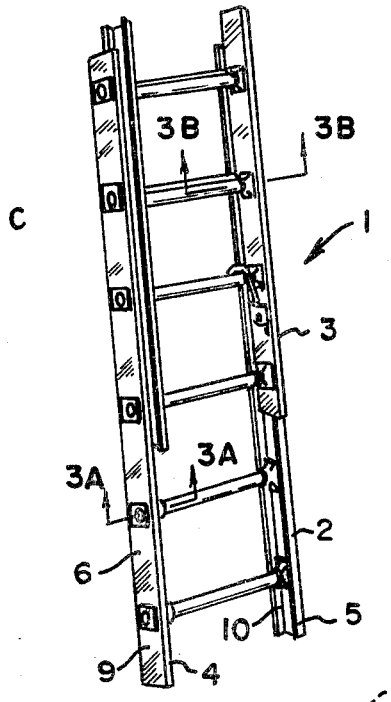
FIG. 1 is a view in perspective of one illustrative embodiment of ladder constructed in accordance with the principles of this invention.

Referring now to FIG. 1, reference numeral 1 indicates one illustrative embodiment of ladder constructed in accordance with the principles of this invention. The ladder 1 includes a base section 2 and a fly section 3, which are interconnectable with one another in a conventional extension ladder arrangement. Each of the base 2 and fly 3 is constructed from a suitable fiberglass material. Because of its fiberglass construction, ladders of this invention find specific use in applications which require electrically nonconductive ladders, as for example, in the electrical utility industry.

The base section 2 and fly section 3 generally have common structural features, although they may vary in physical size. Each includes a pair of side rails 4 and 5 respectively. The side rails 4 and 5 may assume a variety of configurations. Commonly, I-beam, C-channel, and solid cross sectional rails are employed in ladder designs. The particular ladder illustrated in the drawings is of the C-channel design, so that each side has a web 6 connecting a flange 7 and a flange 8, as is best observed in FIG. 3. Equivalent structure is available with each cross sectional shape commonly used in ladder construction. The web 6 has a pair of broad faces or surfaces 9 and 10 separated by the material thickness of the web. In constructing the ladder 1 of this invention, the web 6 has a rung hole 12 formed in it, extending through the faces 9 and 10 of the web 6. A plurality of satellite holes 11 are positioned in a predetermined relationship with the rung hole 12, as is best observed in FIG. 12. The rung hole 12 and associated satellite holes 11 are spaced from one another along the longitudinal length of the side rails 4 and 5 so that individual opening groups in one side rail are aligned with respective individual opening groups in the second side rail.

Figure 2:
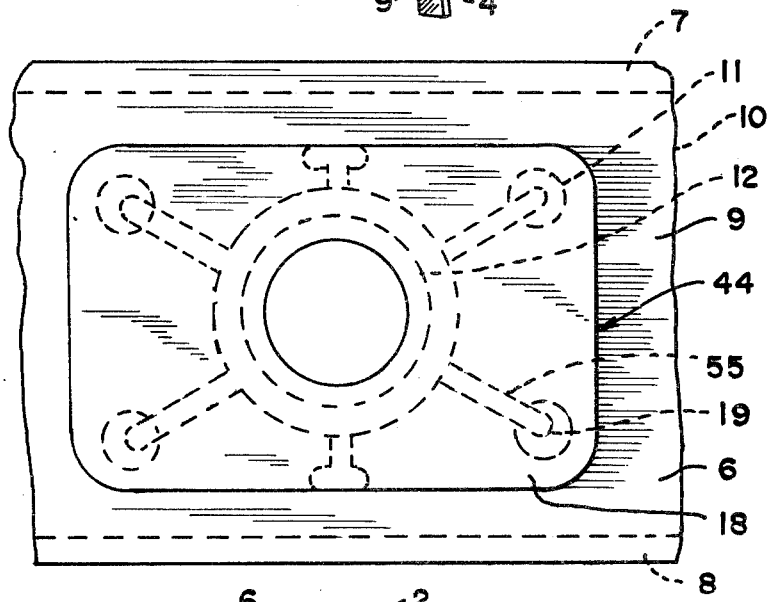
FIG. 2 is an enlarged view, partly broken away, showing the mold position with respect to a side rail of the ladder embodiment of FIG. 1.
Figure 13:
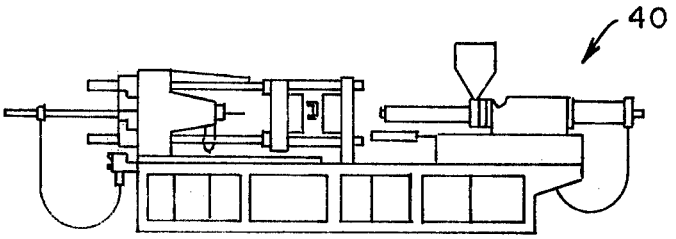
FIG. 13 is a view in side elevation of an injection molding machine, showing one station at which a rung bracket of a side rail of a ladder of this invention is being formed.
Figure 14:
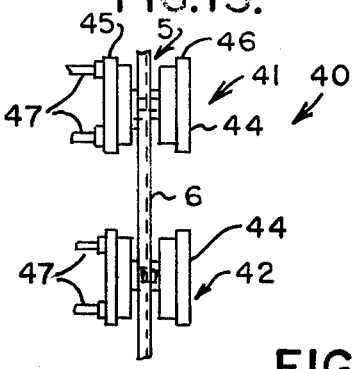
FIG. 14 is a fragmentary top plan view showing two stations at which rung brackets are being molded simultaneously.

After hole 11 and 12 formation, the side rails 4 and 5 are placed in a suitable injection molding machine 40 shown somewhat diagrammatically in FIGS. 13 and 14. The injection molding machine 40 preferably includes a first station 41 and a second station 42. While a two station injection molding machine 40 is described in detail, injection molding apparatus having a fewer or greater numbers of stations may be employed, if desired. The machine 40 preferably is designed to receive at least individual ones of the side rails 4 and 5 and to move predetermined lengths of the rails past the stations 41 and 42. Each of the stations 41 and 42 include a mold 44 having first and second parts 45 and 46, respectively. As is observable in FIG. 2, the mold 44 engages the web 6 and covers the satellite opening 11 and the rung opening 12. Thereafter, a suitable material is injected into the mold parts 45 and 46 along a connection means 47. The connections means is positioned on a first side of the web 6 and the material is injected into the mold parts 45 and 46 from a single side of the web. The material may be formed into a variety of shapes about the openings 11 and 12, and preferred constructional designs are discussed below. The rails are advanced through the stations 41 and 42 until all the rung holes required for a particular ladder design are provided with a rung bracket 15.

Figure 3:
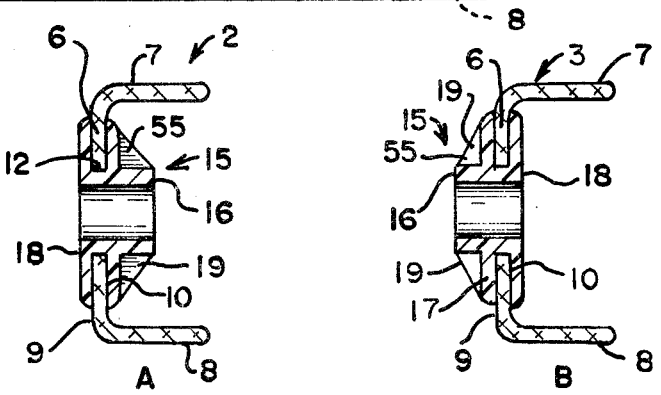
FIG. 3 is a pair of sectional views generally taken along the lines a—a and b—b of FIG. 1, the rung being removed in the view for drawing simplicity.

Referring now to FIG. 3, it will be observed that the rung bracket 15 includes a rung receiving boss 16, a base part 17, a pad part 18, and tying members 19 which extend outwardly from the boss 16 to and through the satellite holes 11 to the pad part 18. The tying members 19 serve a number of functions. First, they attach the bracket 15 to the web 6 and permit the bracket 15 to be constructed from a material different from the material of the web. Second, they provide structural support for the boss 16. Third, they permit formation of the bracket 15 from a single side of the web. Finally, they reinforce the side rails along the satellite openings 11 and the boss 16 along a plurality of ribs 55 extending between the boss 16 and the base part 17.

Figure 4:
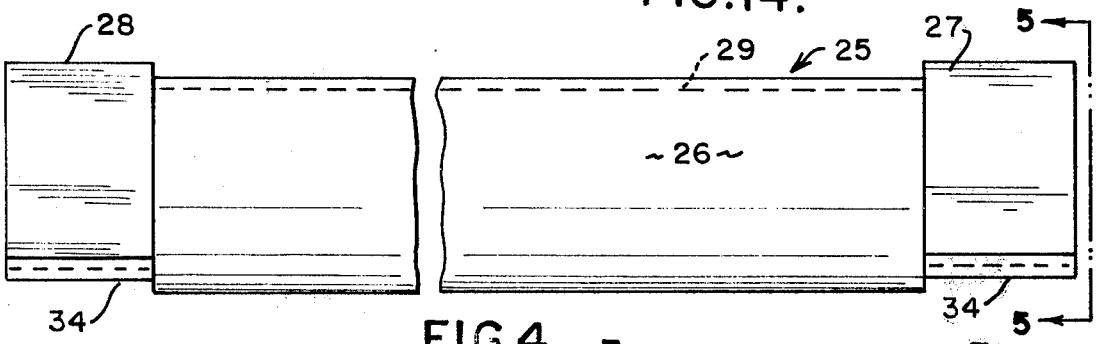
FIG. 4 is a view in side elevation, partly broken away, of one embodiment of rung.
Figure 5:
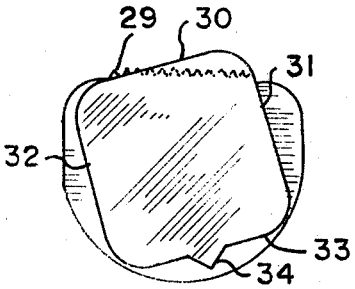
FIG. 5 is a view in end elevation taken along the line 5—5 of FIG. 4.

The particular configuration of the rung boss 16 and rung employed therewith may vary in embodiments of this invention. Thus, one particular rung 25 is shown in FIG. 4. The rung 25 includes a body member 26 having offset ends 27 and 28. The body member 26 has a grooved, foot receiving area 29. The ends 27 and 28 generally have a rectangular shape in plan, including sides 30, 31, 32 and 33. In the embodiment illustrated, the side 33 has a locating means 34 integrally formed with it. The locating means 34 extends along the longitudinal length of the ends 27 and 28.

FIG. 10 illustrates a particular rung bracket 15 compatible with the rung 25 of FIG. 4. As is shown in FIG. 10, where like numerals are used, if appropriate, the bracket 15 has a rung receiving hole or boss 16 defined by a flange 35. The flange 35 has a notch 36 formed in it, which is sized to receive the locating means 34. The interconnection of the notch and locating means 34 correctly locates the foot area 29 of the rung 25 with respect to the side rails 4 and 5 of the ladder 1. An open area 37 between the flange 35 and the rung 25 is provided along the ends 27 and 28 of the rung to permit the insertion of a suitable adhesive between the flange and the rung, thereby securing one to the other in a conventional manner.

A rung 24 design having a conventional round body section 50 and ends 38 similar to the ends 27 and 28 of the rung 25 is illustrated in FIG. 11. As indicated, the ends 37 are similar to the ends 27 and 28 and are not described in detail. The ends 37 have the locating means 34 integrally formed with them. The interconnection of the rung 24 and the rung bracket 15 is substantially as described in conjunction with FIG. 10.

Figure 6:
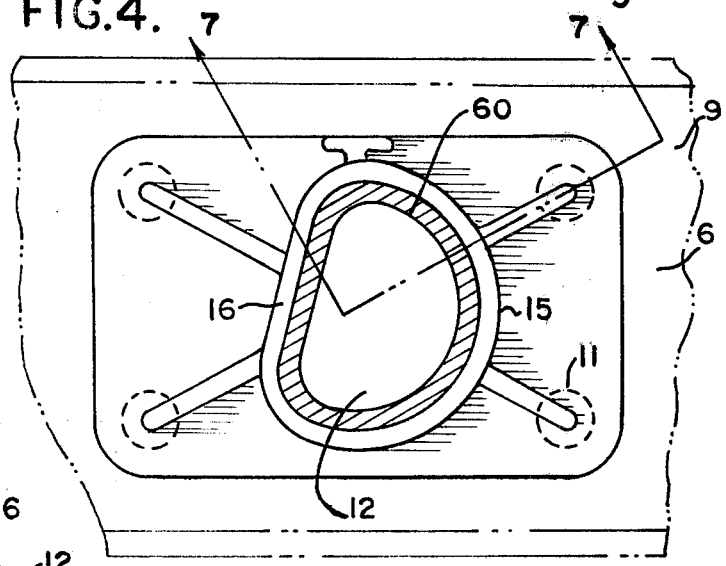
FIG. 6 is a traverse sectional view showing a rung mounted in a rung bracket of one embodiment of ladder of this invention.
Figure 7:
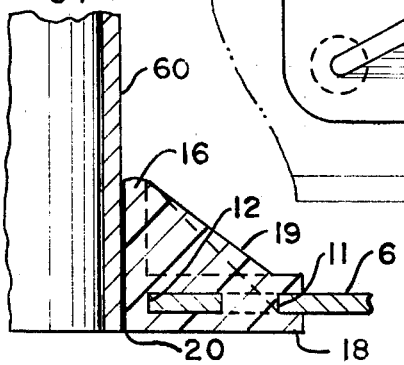
FIG. 7 is a fragmentary sectional view taken along the line 7—7 of FIG. 6.

Another illustrative rung embodiment, denominated by the reference numeral 60, is shown in FIGS. 6 and 7. Again, the web 6 is provided with the openings 11 and 12 and a suitable rung bracket 15 is molded integral with the web. In this embodiment, the rung receiving boss 16 is formed to receive the particular cross sectional shape of the rung 60. In addition, the boss 16 has a predetermined taper 20 associated with it, which permits the application of suitable adhesive between the rung 60 and the bracket 15, thereby bonding one to the other.

FIGS. 8 and 9 illustrate an analogous construction for ladder employing a rung 61. The rung 61 has a circular cross sectional shape, and a uniform cylindrical shape in plan. Again, the bracket 15, and particularly the rung receiving boss 16 portion thereof has a taper 22 which is designed to receive suitable adhesive material to attach the rung 61 to the bracket 15.

As thus described, a ladder construction meeting all the ends and objects herein set forth above is provided.

Numerous variations, within the scope of the appended claims, will be apparent to those skilled in the art in light of the foregoing description and accompanying drawings. Thus, for example, the ends of the various rungs shown all may be formed with an end cap. The caps themselves may be integrally formed with the rungs, or molded in conjunction with the brackets themselves. Although the drawings illustrate a rung receiving boss in the drawings, it will be apparent to those skilled in the art that the interconnection between the rung and bracket may be reversed so that the bracket 15 provides a male connection for the various rungs shown and described. Although a C-channel side rail ladder is shown and described, those skilled in the art will recognize that the ladder side rails may be a variety of cross sectional shapes. In the alternative, solid fiberglass rails may be employed, if desired. Although particular materials were described as preferred for constructing particular components of the ladder 1, other materials are compatible with the broader aspects of this invention. These variations are merely illustrative.

Having thus described the invention, what is claimed and desired to be secured by Letters Patent is:

1. In a ladder having two elongated side rails each with a web, said web having two broad surfaces with spaced holes, said spaced holes including a large, central rung receiving hole in it, and smaller holes spaced outwardly from said central hole, and rungs supported by and extending between the webs of said side rails at spaced locations, the improvement comprising a rung bracket molded in place on said web having on one side of said web a hollow, rung receiving boss and a base part, and on another side of said web, a pad part, said pad and base parts covering all of said small holes, and tying members integral with the base and pad parts connecting said parts and extending through said holes in said web, said tying members of said bracket extending through all of said smaller holes and defining ribs extending from said base part to said boss, individual ones of said ribs being at least in part congruent with individual ones of said smaller holes so that said bracket is moldable in place on said web from a single side of said web.

2. The improvement of claim 1 wherein said rung receiving boss has a non-circular rung receiving opening in it.

3. The improvement of claim 1 wherein said rung receiving boss has a rung receiving opening defined by a wall which diverges in the direction toward the pad part, further including an integral end of said rung in said opening, and adhesive in the space between the divergent wall of said boss and the integral end of said rung.

4. The improvement of claim 1 wherein each of said rungs have a first end and a second end, said first and second ends having a rectangular shape in plan, a first side of said rectangular shape having a locating means formed along it, the boss of said bracket having a notch sized to receive said locating means.

5. In a ladder having two elongated side rails each with a web, said web having two broad surfaces with spaced holes in them, said spaced holes including a central rung receiving hole and smaller holes spaced outwardly from said central hole and rungs supported by and extending between the webs of said side rails at spaced locations, the improvement comprising a rung receiving bracket molded in place on said web having on one side of said web means for interconnecting said bracket with said rung including a boss extending in a direction outwardly of said web and a base part, and on the other side of said web, a pad part, and tying members integral with said base and pad parts, said tying members connecting said base and said pad parts and extending through the smaller holes in said webs, said tying members defining support means integrally formed with the boss of said interconnecting means, said tying members and said smaller holes being arranged so that the bracket is moldable in place on said web from a single side of said web.

* * * * *